10/22/85 OR 4,548,337

United States Patent [19]

Morris

[11] Patent Number: 4,548,337

[45] Date of Patent: Oct. 22, 1985

[54] DISPENSER APPARATUS FOR THE CONTENTS OF COMPRESSIBLE AND COLLAPSIBLE TUBES

[76] Inventor: Donald A. Morris, R.R. 5, Crawfordsville, Ind. 47933

[21] Appl. No.: 501,278

[22] Filed: Jun. 6, 1983

[51] Int. Cl.[4] ..... B65D 35/54

[52] U.S. Cl. ..... 222/96; 222/105; 222/386; 222/505; 251/294; 251/326

[58] Field of Search ..... 222/92, 94, 95, 96, 222/101, 102, 105, 107, 252, 263, 325, 326, 386, 389, 505, 506, 180, 181, 185; 251/294, 326

[56] References Cited

U.S. PATENT DOCUMENTS

| | | | |
|---|---|---|---|
| 1,207,534 | 12/1916 | Gammeter | 222/102 |
| 1,576,821 | 3/1926 | Hamilton | 222/95 |
| 1,710,658 | 4/1929 | George | 222/102 |
| 1,715,335 | 5/1929 | Cocks | 222/95 |
| 1,751,129 | 3/1930 | Cocks | 222/95 |
| 2,085,673 | 6/1937 | Roache | 222/102 X |
| 2,496,004 | 1/1950 | Geyer | 222/102 |
| 2,551,909 | 5/1951 | Soileau | 222/95 X |
| 2,784,878 | 3/1957 | Theodorou | 222/95 |
| 3,257,039 | 6/1966 | Trutza | 222/102 |
| 3,738,533 | 6/1973 | Bertrand | 222/102 |
| 3,753,516 | 8/1973 | Crider | 222/95 |
| 3,860,147 | 1/1975 | Vessio et al. | 222/96 |
| 4,223,809 | 9/1980 | Martin | 222/96 |
| 4,226,336 | 10/1980 | Young | 222/102 |
| 4,508,239 | 4/1985 | Rozzen | 222/39 |

*Primary Examiner*—Joseph J. Rolla

*Assistant Examiner*—Michael S. Huppert

*Attorney, Agent, or Firm*—Woodard, Weikart, Emhardt & Naughton

[57] ABSTRACT

A dispenser apparatus for dispensing a portion of the contents from compressible tubular containers such as those used for toothpaste includes a plastic housing member having one portion designed for the receipt of an air pressure pump and associated linkage, and a second outward portion in communication with the air pressure pump but otherwise sealed, and a front panel portion hinged to the remainder of the housing for selectively opening and closing the second outward portion so as to define a sealed chamber. A tubular container such as a toothpaste tube is placed in the sealed chamber and the side walls of the tube are compressed by the introduction of air pressure into the sealed chamber. The bottom surface or wall of the housing includes an internally threaded outlet which is rigidly secured to the housing and which is suitably designed to receive the threaded end of the tubular container such that when one tube is empty, it may be unscrewed and a new tube screwed into this outlet. A mechanical linkage connects the air pressure pump to an exterior pushbutton control and the connecting linkage also cooperates with a pulley arrangement to selectively open and close a slide valve disposed over the outlet such that as the air pressure pump is activated the valve is opened and when the air pressure pump is deactivated, the valve closes.

5 Claims, 6 Drawing Figures

DISPENSER APPARATUS FOR THE CONTENTS OF COMPRESSIBLE AND COLLAPSIBLE TUBES

BACKGROUND OF THE INVENTION

The present invention relates generally to the construction and styling of dispenser apparatus for home care and beauty aids which are provided in collapsible or compressible tubes. More particularly, the present invention relates to the use of air pressure in order to compress or collapse such tubes for the automatic dispensing of a portion of the contents.

The concern over the dispensing of home care products and beauty aids is not necessarily a new concern. Since dispensing devices have a certain appeal, not merely for the uniqueness of the gadgetry that may be involved, but for some very logical and practical reasons, a number of dispenser styles have been conceived. On the practical side of things, dispensing devices should offer convenience, maintenance of sanitary conditions, ease in dispensing, control in the amount dispensed and optimal utilization of the contents. Optimal utilization of the product being dispensed is mentioned in part due to the existence of aluminum (or similar soft metal) toothpaste tubes which offer one of the more troublesome dispensing challenges. There simply is no convenient and effective way to completely empty the tubes, and while a number of attempts have been made as evidenced by the patent references listed below, there does not presently exist a suitable device. Representative of attempts at dispensing the contents from aluminum tubes are the following references:

| U.S. Pat. No. | Patentee |
|---|---|
| 3,257,039 | Trutza |
| 3,860,147 | Vessio et al. |
| 4,226,336 | Young |
| 3,738,533 | Bertrand |
| 1,207,534 | Gammeter |
| 2,496,004 | Geyer |

Trutza discloses a tube dispenser of the type which includes two serrated rollers supported on parallel shafts and disposed on opposite sides of the tube which is retained within a housing and whose outlet end extends through a lower end of the housing. The two parallel shafts are drawn together at each end by spring arrangements thereby allowing some movement, yet retaining the two rollers in a parallel relationship to each other and suitably arranged to compress the tube as they move downwardly along the length of the tube. Downward movement is initiated by a hand lever and a pair of diametrically opposite pins that slidably ride in elongated slots on opposite sides of the housing. This movement mechanism can generally be considered as indexing or ratcheting type of movement, but it is manual in nature and it does employ somewhat involved mechanical parts and linkages for its successful operation.

Vessio discloses a dental hygiene dispenser which is mountable on a wall for dispensing a dentifrice onto a toothbrush. This particular device employs a pair of threaded rods which extend in a direction substantially parallel to the tube and on opposite sides of the tube. A pair of rollers is rotatably mounted on a carriage having portions which are threadedly received by the threaded rod and are turnable by a gear mechanism which is affixed to the ends of the threaded rods. A projection extending through the housing is employed as the means to turn the threaded rods and rotation of these rods in turn forces the roller arrangement to pass across the outer surfaces of the tube thereby collapsing the tube and enabling the discharge of the contents of the tube. Again, this device is manual in nature and employs an extensive arrangement of gears and linkages comprising a large volume of machined parts greatly adding to the overall cost.

Young discloses an apparatus for dispensing the contents of a tube and its overall mechanical configuration is somewat similar to that disclosed by the Vessio reference. In Young, a pair of rollers is carried by a movable platen whose ends are received by a pair of rack bars suitably supported for reciprocal movement within the housing. Manual pressure on the platen creates incremental movement that depresses the contents of the tube through a spout device enabling discharge of the tube contents.

Bertrand discloses a motorized collapsible tube dispenser which is electrically operated and designed for the dispensing of products such as toothpaste and shaving cream. The device includes an enclosure in which the tube is suspended by a space and its contents are discharged at the bottom of the enclosure. Squeezing pressure upon the tube is provided by a pair rollers which travels downward on both sides of the tube and which is activated by means of an electric motor. This particular device is believed to be an improvement over the prior devices in that it has avoided the manual aspect, by going to an electric motor, and has reduced some of the mechanical complexity. However, the device is still believed to be mechanically complex due to the fact that the motor output must be coupled to other mechanical linkage and drive members by means of the gear arrangement. As is well known, the cost of such gearing can quickly make the product prohibitive as an economical consumer device. In addition to the gear cost and the machine parts which are required, the electric motor adds additional cost to the device over what would be present with manual systems.

Gammeter discloses a fire extinguisher and while the subject matter may be somewhat remote from the present invention, it is nevertheless disclosed for its roller and linkage arrangement which is employed to compress and squeeze the sides of a tube in which the fire-extinguishing medium is contained. Again, this manual type of linkage with the opposing type of rollers is very similar to the other devices previously mentioned, and the Gammeter disclosure does not offer anything particularly new over those prior disclosures.

Geyer discloses a dispensing apparatus of the type which is adapted to be associated with a collapsible tube containing toothpaste or similar contents. The device employs a slightly different roller arrangement wherein there is one main roller and two secondary rollers on the opposite sides of the tube, and the rollers are drawn across the sides of the tube by a fairly involved sprocket and chain linkage arrangement as well as a ratchet wheel and associated mechanical components. This particular device may be one of the most mechanically complicated of all those listed and offers nothing new as to the general concept of moving a pair of rollers across and downwardly the sides of the tube so as to compress or collapse that tube and discharge a portion of its contents.

Recently certain cosmetic items, as well as toothpaste, have been packaged in flexible tubes made of a resilient, synthetic compound. This changeover from metal tubes means that many of the previously conceived devices are either unworkable or grossly overcomplicated for the task at hand. With these flexible and resilient synthetic tubes, significantly less compressive or squeezing force is needed in order to squeeze out a portion of the contents of those tubes. Comparing similarly sized and shaped metal tubes with the synthetic tubes, one quickly realizes that the level of force required is significantly reduced, and the resilient characteristics of the newer tubes creates some different concerns with regard to the mechanism that is used to dispense the contents. It should also be understood that since the plastic (synthetic) tubes are resilient, all that is required is to apply more pressure to the sides of the tube as the contents are discharged.

By simplifying and/or reducing the number of complex and expensive machine parts, elimination of gears, threaded rods and the like, improvements can be made to the devices disclosed by the above-listed patents. Such improvements are provided by the present invention which employs a sealed chamber into which the tube is placed and an air pump communicating with that chamber wherein the buildup of air pressure is used to compress the side walls of the tube and thereby discharge the contents of the tube. As the amount within the tube decreases, the amount of air pressure needed to effectively dispense the contents increases slightly, but the unit is completely automatic, necessitating only the pushing of a button to activate the air pump and dispense the contents.

An alternative embodiment of the present invention uses the same air pressure concept but as opposed to directly collapsing the side walls of the tube by the air pressure, a roller plate arrangement which has a tube-receiving slot centrally positioned therein is pushed downwardly in the longitudinal direction of the tube. This type of an arrangement effectively utilizes the beneficial aspects of air pressure but is suitable for metal tubes which may still exist in the marketplace. Although it uses a roller and compression concept, it is able to eliminate a majority of the mechanical complexity and cost by utilizing air pressure. While this approach may appear similar to the older mechanical styles, the device is an improvement not only from the convenience but also from the cost aspect.

SUMMARY OF THE INVENTION

A dispenser apparatus for dispensing a portion of the contents from a compressible tube or like container according to a typical embodiment of the present invention comprises a housing member defining an interior chamber and having a panel portion which is adapted and arranged to selectively open or close the interior chamber, pressurizing means disposed in cooperation with said interior chamber for increasing the pressure within said interior chamber when said interior chamber is closed by said panel portion, outlet means disposed within said interior chamber and adapted for receiving said compressible tube, and sealing means disposed between said panel portion and said interior chamber for tightly sealing said interior chamber when in said closed condition in order to enable the build-up of pressure within said interior chamber and compression of said tube.

One object of the present invention is to provide an improved dispenser apparatus for dispensing a portion of the contents from a compressible tube.

Related objects and advantages of the present invention will be apparent from the following description.

DESCRIPTION OF THE PREFERRED EMBODIMENT

Figure 1:
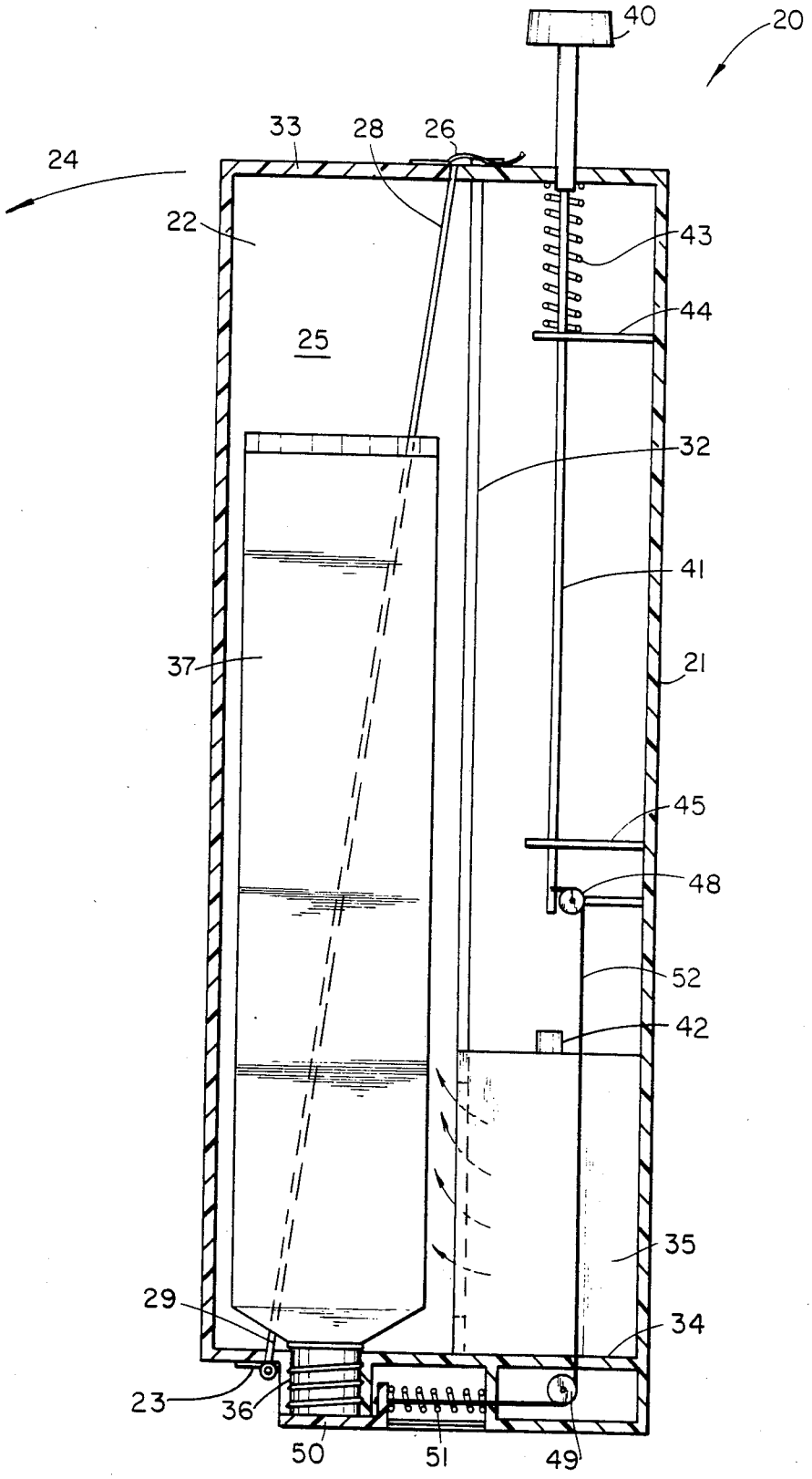
FIG. 1 is a side elevation view in full section of a dispenser apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a dispenser apparatus 20 which includes a main housing 21 and cooperating therewith is a front panel portion 22 which completes the housing enclosure. Front panel portion 22 is connected to the remainder of the main housing 21 by hinge 23. As should be understood, front panel portion 22 is able to open outwardly in the direction of arrow 24 exposing an interior chamber 25. While the front panel portion 22 is hinged to the remainder of the main housing by hinge 23, this front panel portion may also be closed and sealed shut by clasp 26 which is designed much like the clasp on a toolbox such that the ring of the clasp may be placed over the retaining portion on the closing member and then as the tongue of the clasp is moved into position, the degree of tightness between the lid and the base is increased.

As is to be understood, there is an angle or inclined edge separating the front panel portion 22 from the remainder of the main housing. Disposed along this edge and about the complete periphery of the front panel portion 22 is a gasket 28 which is configured as a large U-shaped grommet which is rigidly secured to the front panel portion with the rounded portion of the U-shaped gasket protruding toward abutment edge 29 which is part of the main housing which separates the front panel portion from the remainder. As should be understood, as the front panel portion is swung to a closed position, the gasket 28 makes abutting contact against edge 29. Continued pivoting movement toward a closed condition forces gasket 28 against edge 29 with greater pressure at which point clasp 26 is able to first be engaged on its corresponding and cooperating member which is fixed to main housing 21. Then, as the clasp is activated so as to lock it into a closed condition, even greater pressure is placed on the interface between gasket 28 and edge 29 thereby providing a sealed closure.

Interior chamber 25 is separated from the remainder of the dispenser apparatus by an interior wall 32. Although interior wall 32 extends from top surface 33 downwardly and is sealed against the opposite side walls, it terminates short of bottom wall 34 at which point it engages the outer periphery of a pump 35. Pump 35 provides pressurizing air through wall 32 into interior chamber 25 such that with the clasp closed and the gasket in sealing contact around edge 29, the interior pressure of chamber 25 increases. While the particular specifications for pump 35 may be set at any desired level, it is believed that only a moderate level of pressure increase is required when the tube to be compressed is made of a flexible and resilient synthetic compound such that only a very low level of pressure is required in order to compress the side walls thereby decreasing the interior volume and forcing out a portion of the contents of the tube. Air pump 35 may either be designed for operation off of 110 VAC or DC by battery operation. The particular choice as to energy sources for the pump will, of course, depend on the pump selection, but what is important to recognize is that the pump selected must be reasonably small and able to generate a sufficient level of air pressure without being shut off or yielding to the back pressure which may develop.

By structuring bottom wall 34 with an integral and internally threaded outlet 36, it is to be understood that tube 37 has its normal cap removed and then is screwed into the internal threads of outlet 36 thereby rigidly securing the tube into main housing 21. In order to remove and install new tubes as the contents are exhausted, clasp 26 is sprung open and front panel portion 22 extended outwardly in the direction of arrow 24. The empty tube is then unscrewed from outlet 36 and a new tube is installed. Thereafter, front panel portion is closed and clasp 26 is locked thereby reestablishing the sealed connection between gasket 28 and main housing edge 29.

While the design of pump 35 may vary, it is important that an on/off switch be provided such that when the switch is engaged, the pump will generate air pressure into chamber 25, and when the switch is disengaged or turned off, the buildup of air pressure is halted. The buildup of pressure is then allowed to bleed back through the pump or alternatively, a bleed valve may be provided that is selectively opened and closed in cooperation with the pump's operation. One of the more direct and straightforward switch locations is along an outer wall of the pump such that it extends directly through the main housing wall and thus can be directly activated manually by one's thumb or finger. Based upon the theory of operation of the present invention, it is felt that a momentary switch of the normally-open style is most appropriate so that the pump only operates as the switch is depressed and upon release halts its operation immediately.

In the event the pump switch is disposed along a top surface relative to the location of air pressure generation, then a mechanical linkage is employed so as to activate the pump switch. Such a linkage is disclosed in FIG. 1 and it includes a pushbutton 40 which is connected by stem 41 to activate pump switch 42. Although using a normally open momentary switch for pump switch 42, release and return of pushbutton 40 occurs, by means of a back-up spring 43 which is disposed about stem 41 and retained in place by guide 44. A second guide 45 is provided toward the lower end of stem 41 and thus the selective and manual energizing and deenergizing of the pump switch is thereby provided.

A further aspect of the present invention involves the means to open and close outlet 36 such that the contents of the tube are not exposed to the atmosphere except at those times when the contents are being dispensed. Consequently, the linkage which enables the operation of pump switch 42 by means of pushbutton 40 also activates a pulley and slide valve arrangement so as to open and close outlet 36 with each activation and then deactivation of pump switch 42. This arrangement includes a first pulley 48, a lower pulley 49, a slide valve 50 and a spring 51 which returns the slide valve to a closed condition over outlet 36 once pushbutton 40 is released. The manner of operation is straightforward. Pulley cable 52 is attached to stem 41 at the lower end of the stem such that with downward movement of the stem, the cable is pulled downwardly around pulley 48 and over pulley 49 thereby pulling back on slide valve 50 and thus opening outlet 36. Pushbutton 40 is released and the stem moves upwardly, slack is provided in the pulley cable allowing the spring 51 to return the slide valve 50 to its closed condition. In the event the cost and complexity of the disclosed linkage is not desired, it is possible to employ a less-convenient means by externally threading outlet 36 and placing a cap over the outlet in order to seal the contents of the tube when the apparatus is not in use. Therefore by that alternative, what would have to be done would simply be unscrew the cap that is over outlet 36 and activate the pump. The contents would then be discharged from the tube due to the pressure buildup within chamber 25 that collapses the side walls of the tube and once the pressure buildup was released and the contents were no longer flowing from the outlet, the cap would be replaced.

Figure 2:
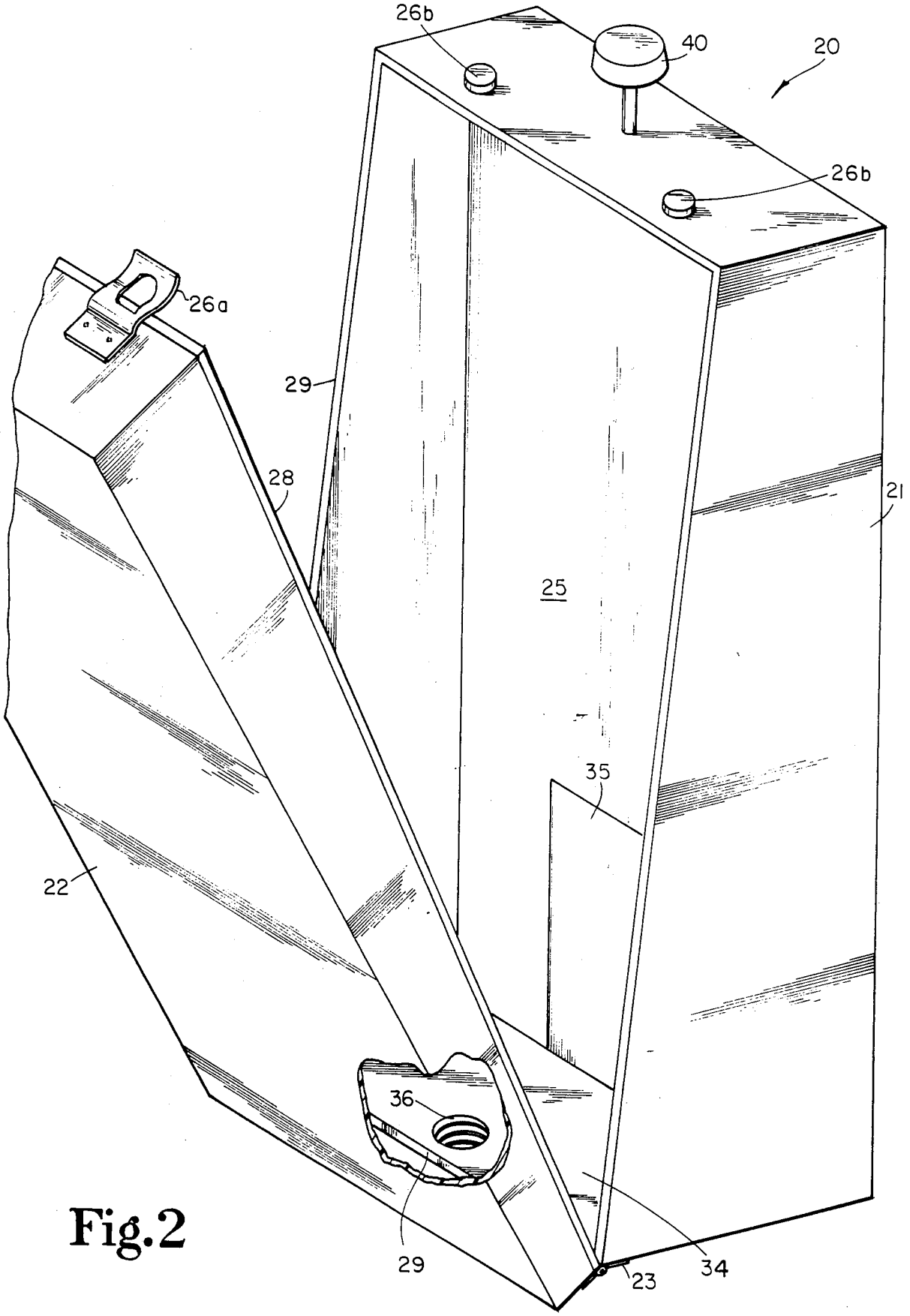
FIG. 2 is a fragmentary perspective view of the FIG. 1 dispenser apparatus.

Referring to FIG. 2, there is illustrated a perspective view of the dispenser apparatus 20 with front panel portion 22 partially raised so as to expose the open interior chamber 25. As is to be understood, clasp 26 may either be of a singular or double design, and the double clasp arrangement is illustrated in FIG. 2 and is believed preferred for the overall balancing of the force distribution and the integrity of the seal between gasket 28 and edge 29. As is illustrated, each clasp 26 includes a first portion **26*a* which is disposed as part of the front panel portion and a second cooperating portion 26*b* which is attached to the remainder of main housing 21. Outlet 36 is somewhat centrally disposed within bottom wall 34 such that various sizes of tubes may be placed within chamber 25 yet still allowing a surrounding space between the side walls of chamber and the walls of the tube so that the air pressure which is introduced into sealed chamber 25** is able to uniformly distribute itself about the tube thereby enhancing the compression of the tube and the discharge of a portion of the contents.

While gasket 28 has been disclosed as of a generally U-shaped configuration fitting over the edges of the front panel portion 22, and being placed in abutment against edge 29, a reverse configuration is also possible with very little difference as to the overall operation and characteristics of the present invention. In other words, it would be equally suitable to dispose gasket 28 about edge 29 and allow abutment between the unexposed edge of the front panel portion directly against the gasket as received on edge 29.

One advantage of the present invention is the elimination of the very complex and expensive mechanical linkage parts and machine component parts which are prevalent in prior art disclosures. As opposed to utilizing mechanical linkages and closely toleranced machined parts for collapsing the particular tube, the present invention relies solely upon air pressure for compression of flexible, resilient synthetic tubes thereby greatly reducing not only the complexity and cost but also the weight of the device. As a result, the present invention may be easily hung on tile walls and other surfaces such as within a bath where weight might otherwise be a concern. The overall housing may be made of a hard and durable plastic or similar synthetic compound thus enhancing its lower weight characteristics as well as its durability and corrosion-resistant properties.

Figure 3:
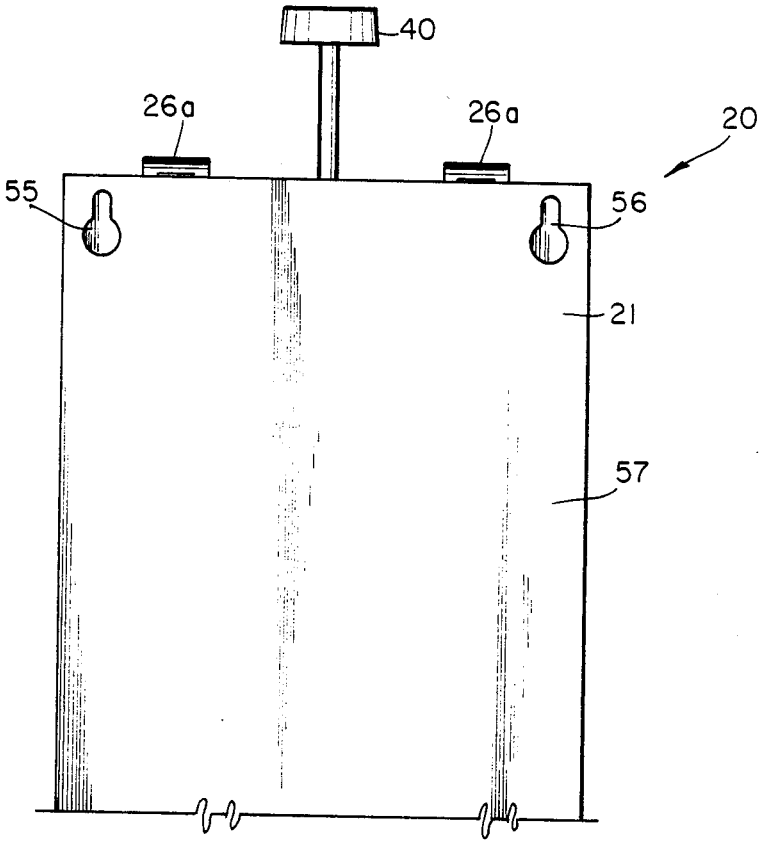
FIG. 3 is a rear elevation view of the FIG. 1 dispenser apparatus.

Referring to FIG. 3, the back surface of the dispensing apparatus 20 is illustrated. Molded into the corners of main housing 21 along this rear surface are wall-mounting slots 55 and 56 which are disposed in the upper outer corners of the main housing and are suitable to slide over the heads of threaded fasteners or nails which may be employed on a vertical surface for support and retention of this dispenser apparatus. As is to be understood, slots 55 and 56 are molded into the back wall portion 57 which provides an interior clearance space for the head of the threaded fastener or nail with the wall slots receiving the shaft or stem portion of the fasteners.

Figure 4:
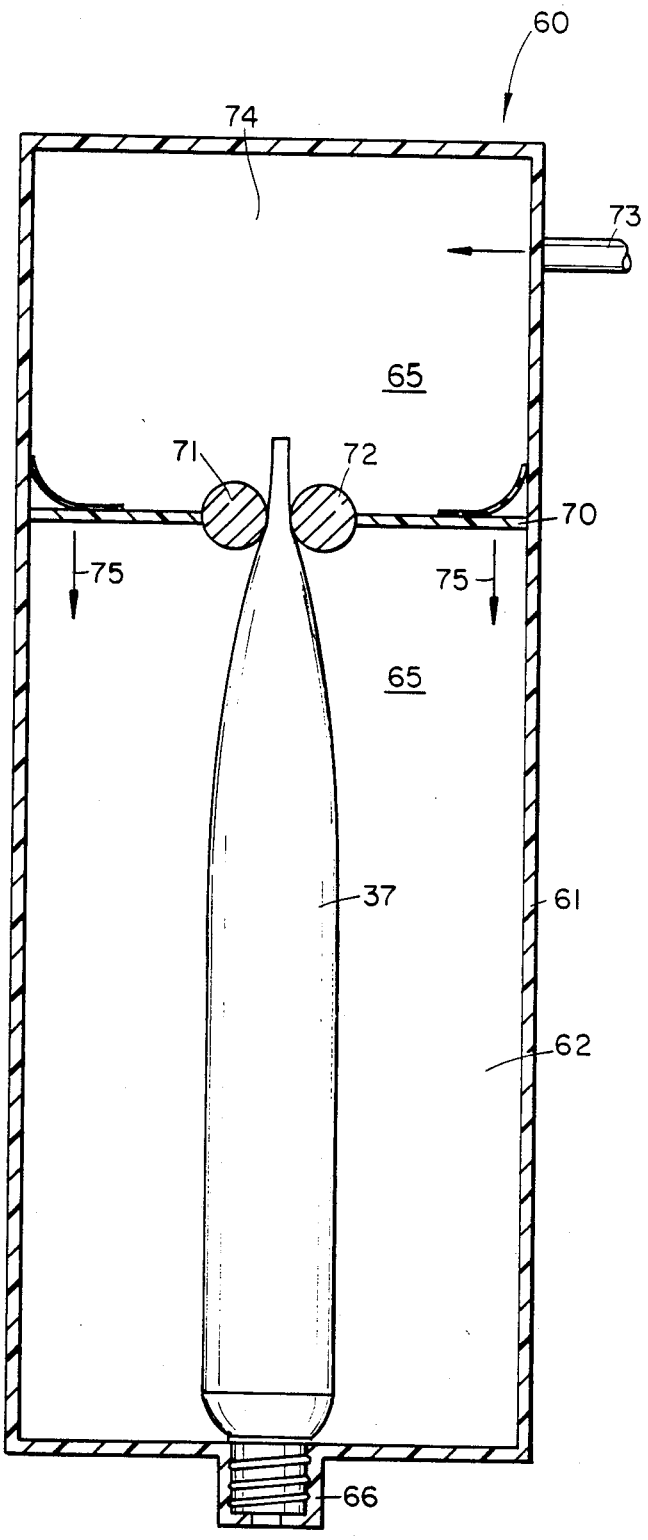
FIG. 4 is a front elevation view in full section of an alternative configuration of a dispenser apparatus according to another embodiment of the present invention.

Referring to FIG. 4, there is illustrated in somewhat schematic form an alternative arrangement to the apparatus disclosed in FIGS. 1–3. This alternative dispenser apparatus incorporates a main housing 61 with a front panel portion 62 with much the same configuration and relationship as was previously disclosed for main housing 21 and front panel portion 22. The two are also hinged together as previously described and include the various outer walls and interior walls resulting in an interior enclosed chamber 65 which may be sealed for the receipt of air pressure for collapsing the side walls of the tube which is received within the chamber. Also provided is threaded outlet 66, again, similar in size configuration and location to that previously described for outlet 36. The primary difference between dispenser apparatus 60 and that disclosed regarding dispenser apparatus 20 is the fact that a guide plate 70 is disposed within chamber 65 and includes centrally supported thereon by molded cylindrical tabs a pair of opposing rollers 71 and 72 whose axis of rotation are generally parallel to each other and whose facing edge separation distance is slightly greater than the thickness of the tube at its bottom or base. Consequently, the end of the tube is of a sufficient size to be inserted between the two rollers while the body of the tube is of greater thickness and cannot pass between the rollers without being compressed. Air pressure from an air pump, again, similar in size and construction to pump 35, is introduced by tube 73 into the top portion 74 of interior chamber 65. By arranging guide plate 70 such that it is sealed relative to the surrounding side walls of the main housing 61, it is to be understood that as air pressure is introduced into top portion 74, this increase in pressure creates a downwardly directed force on guide plate 70 causing it to move downwardly in the direction of arrows 75 and as this movement occurs, rollers 71 and 72 act against the sides of tube 37 causing the sides to be compressed and a portion of the contents discharged through outlet 66.

Figure 5:
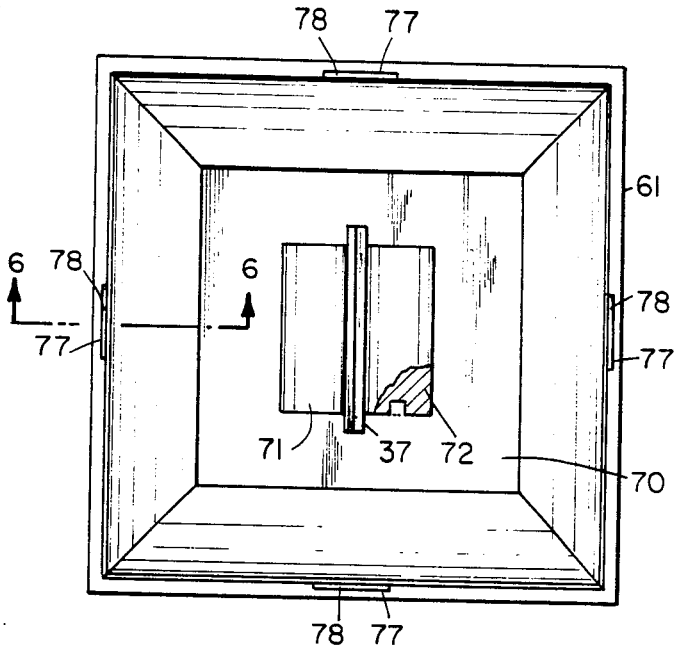
FIG. 5 is a top plan view of the FIG. 4 dispenser apparatus.

While the characteristics of the flexible, resilient tube will determine whether or not the guide plate is pushed upwardly after the increase in air pressure is halted, it should be understood that the rollers will continue to act along the sides of the tube with each sequential use of the apparatus each time moving somewhat lower down the length of the tube as the contents are gradually used. In order to assure a somewhat horizontal orientation of the guide plate as it moves downwardly, the surrounding side walls of housing 21 each have a notch 77 (see FIG. 5) disposed centrally in that particular side wall and cooperating therewith is an engaging tab 78 which is formed as part of the guide plate. By structuring these notches and tabs of a synthetic material, and by providing a reasonably close tolerance fit, it should be understood that this will maintain alignment of the guide plate as it moves downwardly across the body of the tube 37. Any tendency of the guide plate to rock or tilt is prevented due to the fact that interference is created and this interference acts against any tilting or cocking of the guide plate within the various notches.

Figure 6:
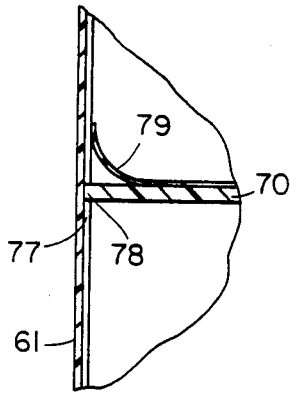
FIG. 6 is a partial, side elevation view in full section of a gasket seal means comprising a portion of the FIG. 4 dispenser apparatus.

Since it is desirable to maintain the close tolerance fit between notches 77 and tabs 78 as opposed to the periphery of the guide plate relative to the interior surface of housing 61, clearance in those other areas may be provided and the only concern which results is the ability to seal that separation so that the pressure buildup within top portion 74 is effectively utilized with a minimum of leakage. In order to solve this problem, a periphery gasket 79 is attached to the outer edge of the top surface of guide plate 70 and the gasket 79 has a length which is sufficient to extend beyond the outer edge of guide plate 70. Thus, with guide plate 70 disposed within housing 61, the gasket is turned upwardly and laid against the interior surface of the various side walls (see FIG. 6). As should be understood the forming of gasket 79 as a complete and integral member and with a square or rectangular shape, the sealing contact of gasket 79 against the interior surface of the side walls of the housing will be increased as pressure builds up. An alternative design for gasket 79 involves the addition of a cylindrical lip to the outer edge so that a sealed interface exists regardess of the direction of movement of the guide plate.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dispenser apparatus for dispensing a portion of the contents from a compressible tube or like container comprising:

a housing member defining an interior chamber and having a panel portion which is adapted and arranged to selectively open or close said interior chamber;

pressurizing means disposed in cooperation with said interior chamber for increasing the pressure within said interior chamber when said interior chamber is closed by said panel portion;

outlet means disposed within said interior chamber and adapted for receiving said compressible tube;

sealing means disposed between said panel portion and said interior chamber for tightly sealing said interior chamber when in said closed condition in order to enable the buildup of pressure within said interior chamber and compression of said tube;

mechanical linkage means for selectively activating said pressurizing means, said mechanical linkage means including an exteriorly exposed pushbutton which is spring-biased and coupled by a stem member to said pressurizing means and wherein said pressurizing means is an air pump having a normally open momentary switch for activating the generation of air pressure; and outlet opening and closing means cooperatively arranged relative to said outlet means for selectively opening and closing said outlet with activation of said pressurizing means by said mechanical linkage means, said outlet opening and closing means including a pulley arrangement in cooperation with a slide valve which is spring-biased.

2. A dispenser apparatus for dispensing a portion of the contents from a compressible tube or like container comprising:

a housing member defining an interior chamber and having a panel portion which is adapted and arranged to selectively open or close said interior chamber;

a guide plate disposed within said interior chamber and separating said interior chamber into a top portion and a lower portion, said guide plate including a central opening bounded on opposite edges by a pair of rollers and wherein the rollers are arranged so as to receive the end of said tube therebetween;

pressurizing means disposed in cooperation with said top portion of said interior chamber for increasing the pressure within said top portion when said interior chamber is closed by said panel portion;

outlet means disposed within said interior chamber and adapted for receiving said compressible tube;

sealing means disposed between said panel portion and said interior chamber for tightly sealing said interior chamber when in said closed condition in order to enable the buildup of pressure within said top portion and movement of said guide plate downwardly toward said outlet means; and said guide plate having a plurality of guide tabs, there being one each on each edge surface of said guide plate and wherein said housing member includes a corresponding plurality of receiving notches for receipt of said guide tabs and for guiding the downward movement of said guide plate.

3. The dispenser apparatus of claim 2 which further includes a gasket member attached to said guide plate and disposed against the walls of said housing member so as to provide sealing for said top portion of said interior chamber.

4. A dispenser apparatus for dispensing a portion of the contents from a compressible tube or like container comprising:

a housing member defining an interior chamber and having a panel portion which is adapted and arranged to selectively open or close said interior chamber;

pressurizing means disposed in cooperation with said interior chamber for increasing the pressure within said interior chamber when said interior chamber is closed by said panel portion;

outlet means disposed within said interior chamber and adapted for receiving said compressible tube, said outlet means including an outlet valve;

sealing means disposed between said panel portion and said interior chamber for tightly sealing said interior chamber when in said closed condition in order to enable the buildup of pressure within said interior chamber and compression of said tube; and mechanical linkage means adapted for selectively activating said pressurizing means and including a cooperating pulley arrangement for simultaneously opening said outlet valve with activation of said pressurizing means.

5. A dispenser apparatus for dispensing a portion of the contents from a compressible tube or like container comprising:

a housing member defining an interior chamber and having a panel portion which is adapted and arranged to selectively open or close said interior chamber;

pressurizing means disposed in cooperation with said interior chamber for increasing the pressure within said interior chamber when said interior chamber is closed by said panel portion;

outlet means disposed within said interior chamber and adapted for receiving said compressible tube, said outlet means including an outlet valve;

sealing means disposed between said panel portion and said interior chamber for tightly sealing said interior chamber when in said close condition in order to enable the buildup of pressure within said interior chamber and compression of said tube; and linkage means movable in a first direction in response to manual force for selectively activating said pressurizing means and being arranged in cooperation with said outlet valve so as to simultaneously move said outlet valve in second direction which is normal to said first direction during activation of said pressurizing means.

* * * * *